United States Patent [19]

Stout

[11] 4,000,813

[45] Jan. 4, 1977

[54] ARTICLE CARRIER

[75] Inventor: James T. Stout, Acworth, Ga.

[73] Assignee: The Mead Corporation, Dayton, Ohio

[22] Filed: Nov. 7, 1975

[21] Appl. No.: 629,711

[52] U.S. Cl. ..... 206/187
[51] Int. Cl.[2] ..... B65D 75/00
[58] Field of Search ..... 206/170–193

[56] References Cited

UNITED STATES PATENTS

| | | | |
|---|---|---|---|
| 2,755,960 | 7/1956 | Kramer | 206/186 |
| 3,443,723 | 5/1969 | Arneson | 206/187 |
| 3,570,706 | 3/1971 | Harrelson | 206/187 |
| 3,669,306 | 6/1972 | Furrer | 206/188 |
| 3,672,539 | 6/1972 | Furrer | 206/188 X |
| 3,712,505 | 1/1973 | Slevin | 206/187 X |
| 3,757,991 | 9/1973 | Stout | 206/187 X |

*Primary Examiner*—William Price
*Assistant Examiner*—Stephen Marcus
*Attorney, Agent, or Firm*—Walter M. Rodgers; Walter A. Rodgers

[57] ABSTRACT

An article carrier is formed from a unitary blank and comprises a bottom panel, side walls foldably joined to the side edges of the bottom panel, end wall panels foldably joined to the end edges of the side walls, riser panels foldably joined to the end wall panels at one end of the carrier, medial partition structure foldably joined to the end wall panels at the other end of the carrier, a pair of outer handle panels secured at one end thereof to the upwardly extending portions of the riser panels and at the other end thereof to the upwardly extending portion of the medial partition structure, a pair of reinforcing panels foldably joined to the outer handle panels along fold lines which are spaced from one end edge of the outer handle panels, at least one anchoring tab secured to the medial partition structure, and a partition strip foldably joined at one end thereof to one side wall and at the other end thereof to the anchoring tab.

8 Claims, 7 Drawing Figures

ARTICLE CARRIER

Known article carriers which utilize the so-called high center cell arrangement in conjunction with a pair of handle panels and a pair of reinforcing panels foldably joined to one end of the handle panels along offset fold lines which are spaced inwardly from said one end of the handle panels, require the use of a composite structure for at least one of the transverse partition elements on each side of the handle because the length of a partition strip is not as great as the distance between the offset fold lines and the usual fold line between one end of the partition strip and the reinforcing panel. Thus the partition strip and reinforcing panel cannot fold into flat face contacting relation to each other so that the partition strip must be severed from the reinforcing panel and anchored to the handle by an anchoring tab not foldably joined to the reinforcing panel. This composite structure requires the use of additional paperboard which increases the production costs of the carrier.

According to this invention an article carrier is provided and comprises a bottom panel, side walls foldably joined to the side edges of the bottom panel, end wall panels foldably joined to the end edges of the side walls, riser panels foldably joined to the end wall panels at one end of the carrier and extending medially inward of the carrier, medial partition structure foldably joined to the end wall panels at the other end of the carrier and extending medially inward of the carrier, a pair of outer handle panels secured at one end thereof to the upwardly extending portions of the riser panels and at the other end thereof to the upwardly extending portion of the medial partition structure, a pair of reinforcing panels foldably joined to the outer handle panels along at least one fold line which is spaced from one end edge of the outer handle panels, at least one anchoring tab secured to the medial partition structure, and a partition strip foldably joined at one end thereof to one of the side walls and at the other end to the anchoring tab.

For a better understanding of the invention reference may be had to the following detailed description taken in condjuction with the accompanying drawings in which FIG. 1 is a persective view of a set-up carrier formed according to the invention;

FIGS. 3, 4 and 5 depict intermediate stages through which the blank of FIG. 2 is manipulated in order to form a complete and collapsed carrier as shown in FIG. 6; and in which

Figure 1:
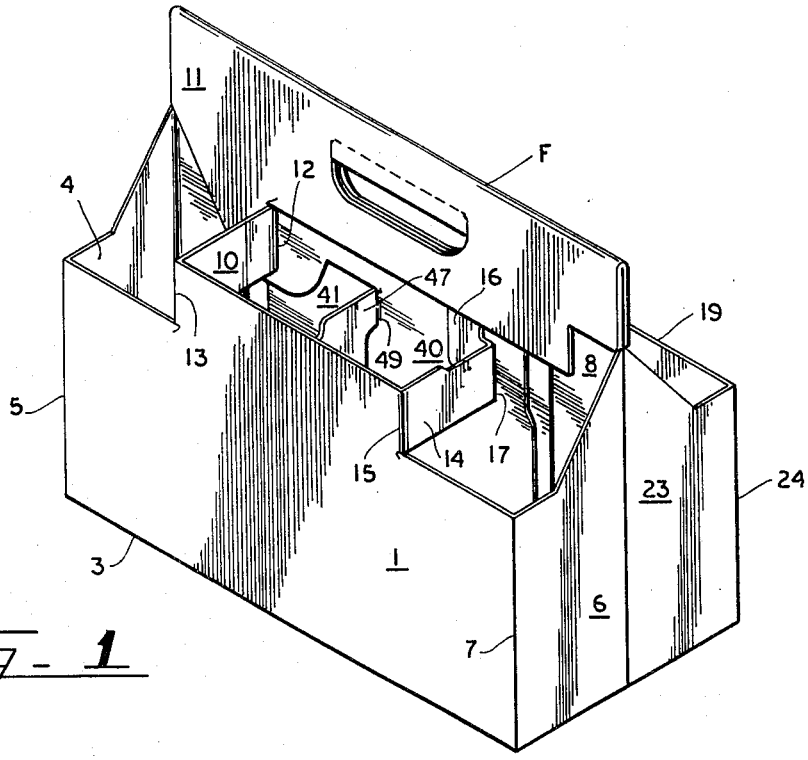

In the drawings the numeral 1 represents a side wall of the carrier to the bottom edge of which a glue flap 2 is foldably joined along fold line 3. End wall panel 4 is foldably joined to an end edge of side wall 1 along fold line 5 while end wall panel 6 is foldably joined to the opposite end edge of side wall 1 along fold line 7. Riser panel 8 is foldably joined to end wall panel 6 along fold line 9 and is provided with notch 8a. Partition strip 10 is foldably joined to outer handle panel 11 along fold line 12 and to side wall 1 along fold line 13. Partition strip 14 is foldably joined to side wall 1 along fold line 15. Anchoring tab 16 is foldably joined to partition strip 14 along tab fold line 17.

The other side of the blank is similar to that just described and includes bottom panel 18 which is foldably joined to side wall 19 along fold line 20 and includes medial fold line 18a. End wall panel 21 is foldably joined to side wall 19 along fold line 22 while end wall panel 23 is foldably joined to the opposite end of side wall 19 along fold line 24. Riser panel 25 is foldably joined to end wall panel 23 along fold line 26 and is provided with notch 25*a*. Partition strip 27 is foldably joined to outer handle panel 28 along fold line 29 and to side wall 19 along fold line 30. Partition strip 31 is foldably joined to side wall 19 along fold line 32 and anchoring tab 33 is foldably joined to partition strip 31 along tab fold line 34. Also outer handle panels 11 and 28 are foldably joined to each other along medial fold line F.

To provide additional strength in the area of the handle, reinforcing panels 35 and 36 are provided and are foldably joined along interrupted fold line 37. Reinforcing panel 35 is foldably joined to outer handle panel 11 along fold line 38 and likewise reinforcing panel 36 is foldably joined to outer handle panel 28 along fold line 39. This basic handle structure is disclosed in U.S. Pat. No. 3,349,957 granted Oct. 31, 1967.

In order to provide necessary medial article separation, medial partition structure is provided and is generally designated by the letter M and includes medial panels 40, 41, and 42. Medial panel 40 is foldably joined to end wall panel 4 and to outer handle panel 11 along fold line 43. Medial panel 41 is foldably joined to medial panel 40 along fold lines 44 and 45. Medial panel 42 is foldably joined to end wall panel 21 and to outer handle panel 28 along fold line 46.

Medial panel 40 is provided with transverse partition panel 47 which in turn is foldably joined to medial panel 40 along vertically coincidental fold lines 48 and 49. In addition anchoring flap 50 is foldably joined to transverse partition panel 47 along vertically coincidental fold lines 51 and 52.

Likewise medial panel 41 is provided with transverse partition panel 53 which in turn is foldably joined to medial panel 41 along vertically coincidental fold lines 54 and 55. Anchoring flap 56 is foldably joined to transverse partition panel 53 along vertical coincidental fold lines 57 and 58.

Figure 2:
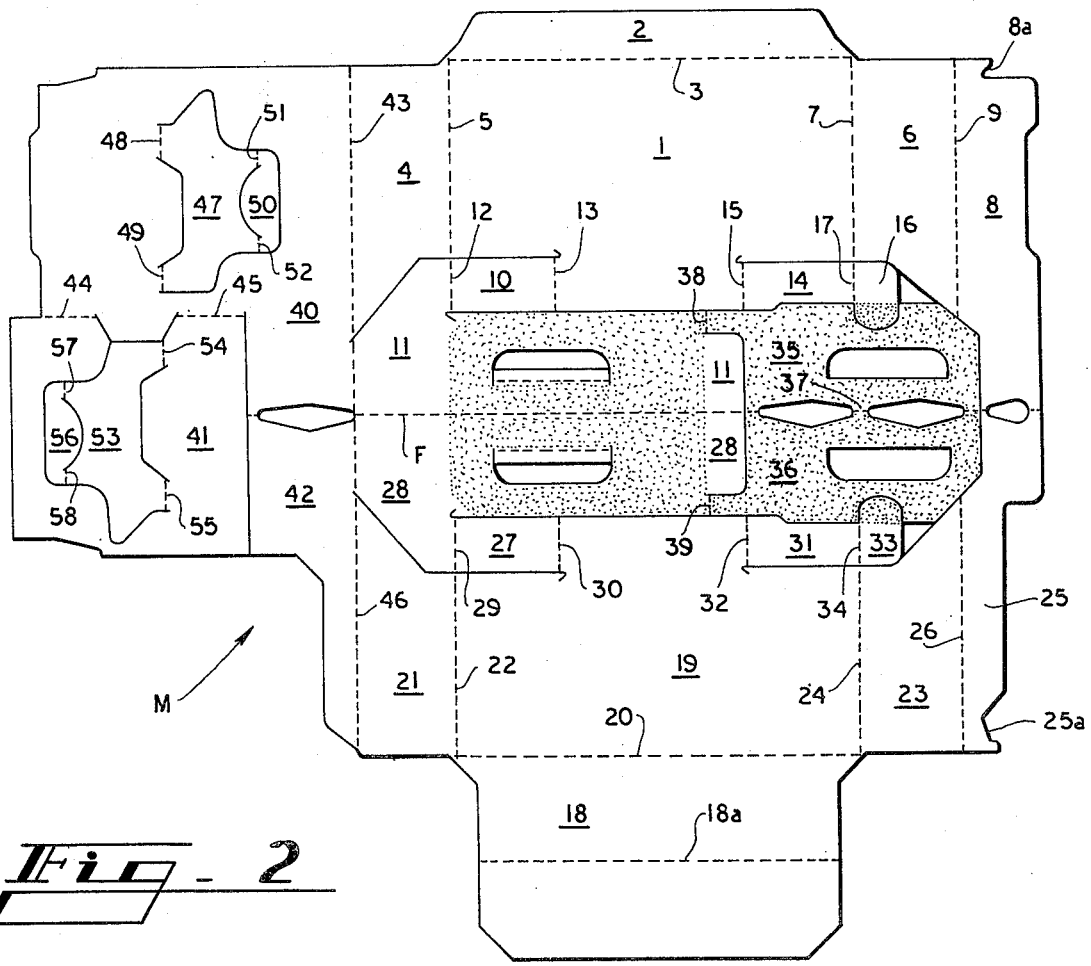
FIG. 2 is a plan view of a blank from which the carrier shown in FIG. 1 is formed.
Figure 3:
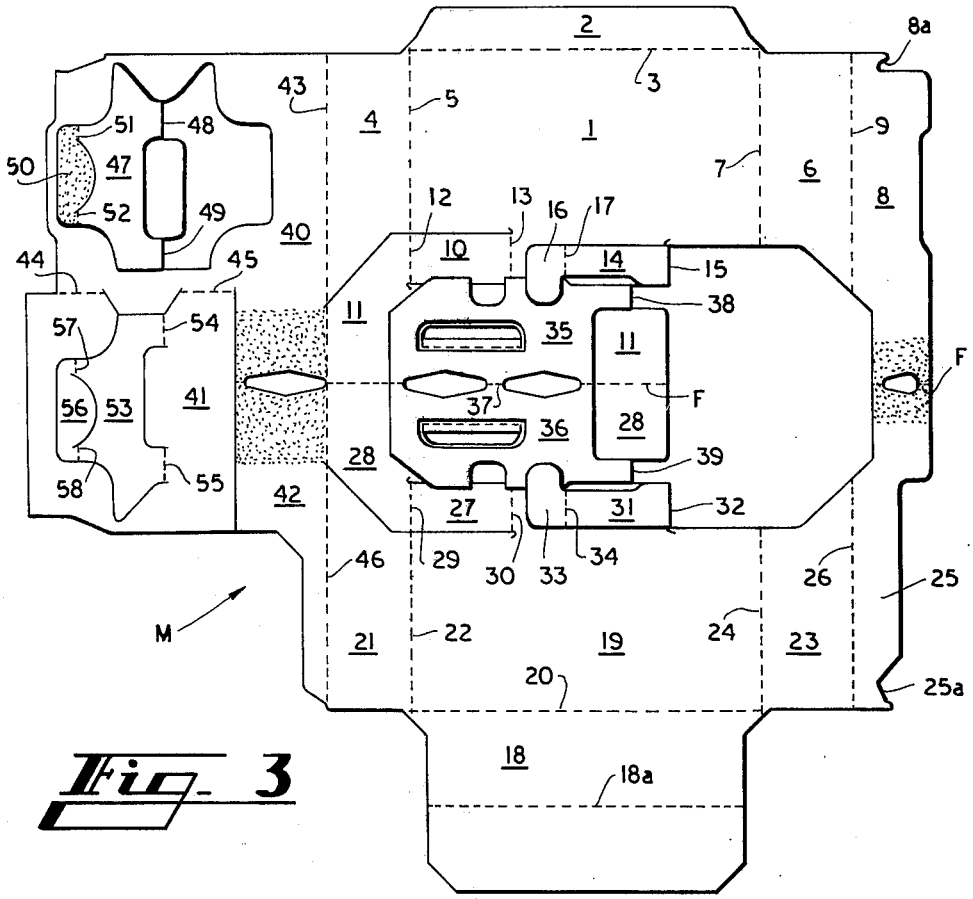

In order to form a completed carrier from the blank shown in FIG. 2, an application of glue is made to reinforcing panels 35 and 36 and to outer handle panels 11 and 28 as shown by stippling in FIG. 2. Reinforcing panels 35 and 36 are then elevated and folded to the left along fold lines 38 and 39 respectively. An application of glue is made to anchoring tabs 16 and 33 which with strips 14 and 31 are then folded upwardly and to the left along fold lines 15 and 32 respectively. The carrier then appears as shown in FIG. 3. As is apparent in FIG. 3, fold line 34 is spaced longitudinally from offset fold line 39 by a distance which is less than the length of partition strip 31. Obviously it would not be possible to make this folding operation if anchoring tab 33 were an integral part of reinforcing panel 36.

Figure 4:
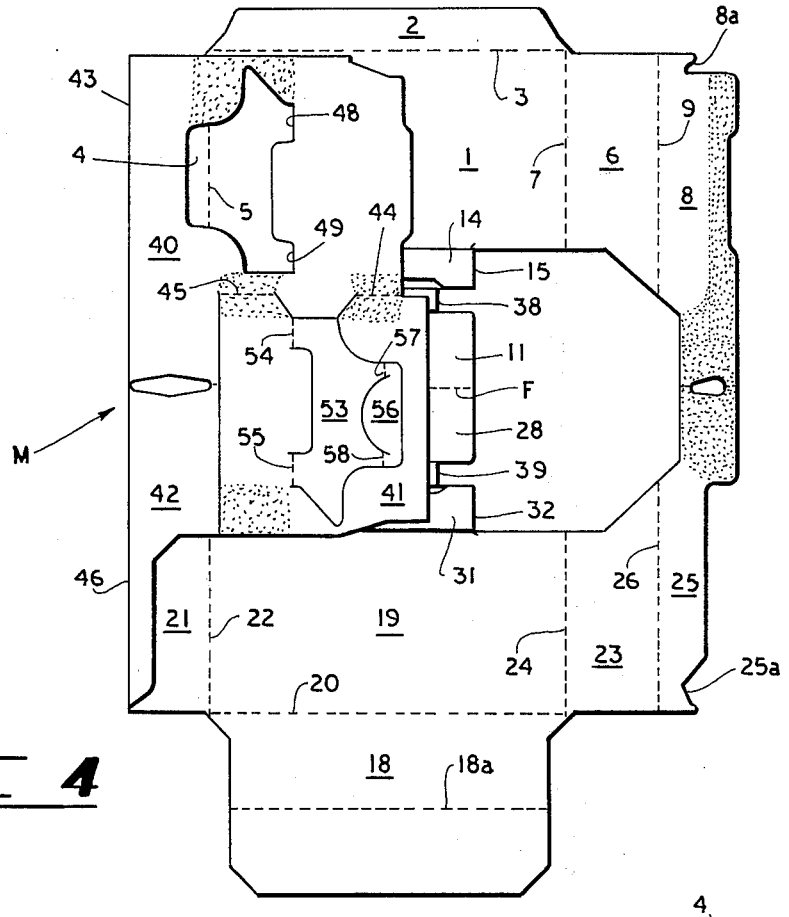

Then transverse partition panel 47 is elevated and folded forward to the left along fold lines 48 and 49. Glue is then applied to anchoring flap 50. Following this medial partition structure M is lifted upwardly and folded toward the right along fold lines 43 and 46. By this operation anchoring flap 50 is adhered to side wall 1. The carrier then appears as shown in FIG. 4. An application of glue is then made to medial panels 40 and 41 as shown by stippling in FIG. 4. Medial panel 41 is then lifted upwardly and folded over into flat face contacting relation with medial panel 40 as best shown in FIG. 5.

Following this an application of glue is made to riser panels 8 and 25 as shown by stippling in FIG. 4. Then riser panels 8 and 25 together with end wall panels 6 and 23 are elevated and folded toward the left along fold lines 7 and 24. By this operation riser panels 8 and 25 are secured to the inner surfaces of outer handle panels 11 and 28 and riser panel 8 is also secured to medial panel 41. Thereafter bottom panel 18 is folded along medial fold line 18*a*. The carrier then appears as shown in FIG. 5.

Figure 5:
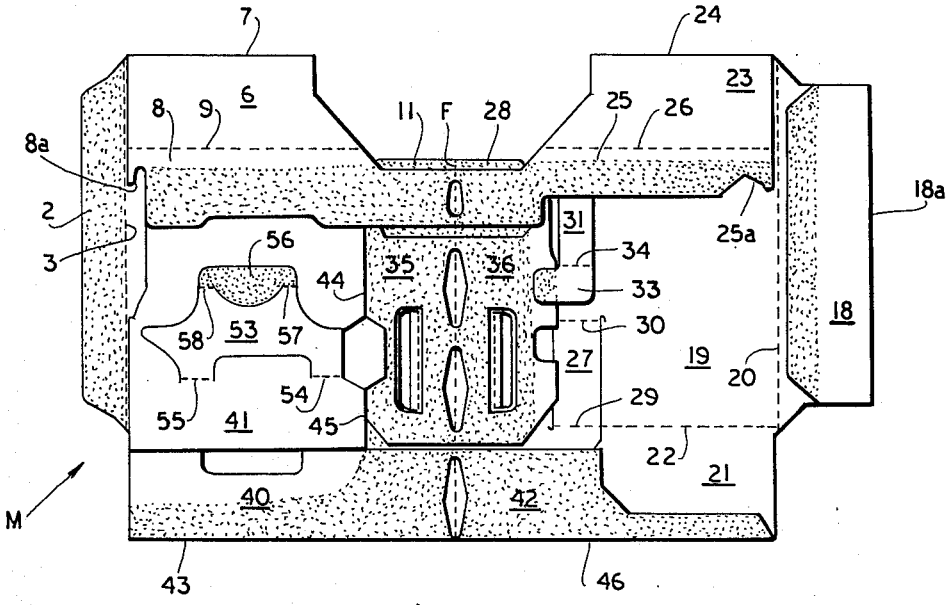

An application of glue is then made to the carrier as shown by stippling in FIG. 5. More specifically glue is applied to glue flap 2, bottom panel 18, riser panels 8 and 25, medial panels 40 and 42, anchoring tab 33, anchoring flap 56, and reinforcing panels 35 and 36. Thereafter the entire left hand portion of the carrier as viewed in FIG. 5 is folded upwardly and to the right along medial fold line F to occupy the position as shown in FIG. 6 which represents the completed carrier in collapsed condition.

Figure 7:
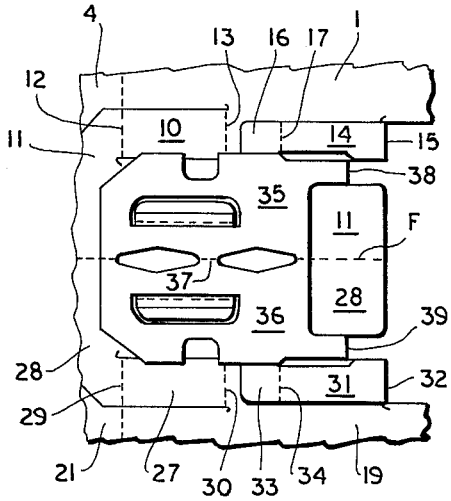
FIG. 7 shows an alternative transverse partition structure.

FIG. 7 represents a fragmentary view of the center of the carrier similar to that shown in FIG. 3 except that during the folding operation partition strips 14 and 31 and their associated anchoring tabs 16 and 33 are folded upwardly and to the left prior to folding reinforcing panels 35 and 36 upwardly and to the left. Therefore anchoring tab 16 is interposed between outer handle panel 11 and reinforcing panel 35 and similarly anchoring tab 33 is interposed between outer handle panel 28 and reinforcing panel 36.

Figure 6:
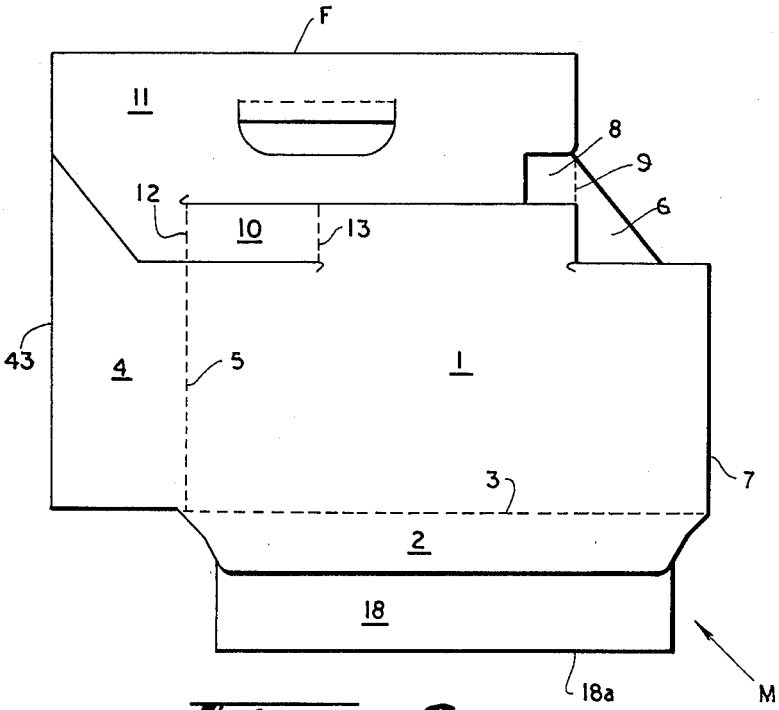

In order to set up the carrier from its collapsed condition shown in FIG. 6 to the set-up condition shown in FIG. 1, it is simply necessary to secure the side walls 1 and 19 against movement toward the right and to apply a force toward the right to the medial edges of end wall panels 4 and 21. This extends the carrier and moves the side walls apart. Simultaneously the bottom wall 18 folds into a flat plane. The carrier is maintained in set-up condition by cooperation between locking notches 8*a* and 25*a* and one end of bottom wall 18. The carrier then appears as shown in FIG. 1.

Therefore it can be seen that by this invention an article carrier is provided which comprises a pair of handle panels in conjunction with a pair of reinforcing panels in the well known high center cell arrangement and embodies the beneficial characteristics of sturdy construction, proper article separation, and economy of material. It can also be seen that this invention is especially adapted for use on an article carrier having four article receiving cells on each side of the handle with each side wall comprising an upraised portion extending the length of two cells and being divided by a transverse partition panel struck from one of the medial panels.

The embodiments of the invention in which an exclusive property or privilege is claimed are defined as follows:

1. An article carrier comprising a bottom panel, side walls foldably joined to the side edges of said bottom panel, end wall panels foldably joined to the end edges of said side walls, riser panels foldably joined to said end wall panels at one end of the carrier and extending medially inward of the carrier, medial partition structure foldably joined to the end wall panels at the other end of the carrier and extending medially inward of the carrier, a pair of outer handle panels secured at one end thereof to the upwardly extending portions of said riser panels and at the other end thereof to the upwardly extending portion of said medial partition structure, a pair of reinforcing panels foldably joined to said outer handle panels along at least one offset fold line which is spaced from an end edge of said outer handle panels and parallel thereto, at least one anchoring tab secured to said medial partition structure, and a partition strip foldably joined at one end thereof to one of said side walls and at the other end to said anchoring tab along a tab fold line which is spaced longitudinally from the offset fold line between said reinforcing panels and said outer handle panels by a distance which is less than the length of said partition strip.

2. An article carrier according to claim 1 wherein a portion of said anchoring tab is interposed between said outer handle panels.

3. An article carrier according to claim 1 wherein a portion of said anchoring tab is struck from the associated one of said reinforcing panels.

4. An article carrier according to claim 1 wherein a portion of said anchoring tab is interposed between said reinforcing panels.

5. An article carrier according to claim 1 wherein said one side wall comprises an upraised portion disposed generally midway between said end wall panels and wherein said partition strip is foldably joined to an end edge of said upraised portion and is spaced from the associated end of the carrier by a distance equal to the length of said partition strip.

6. An article carrier according to claim 5 wherein a second partition strip is foldably joined to the other end edge of said upraised portion and to one of said outer handle panels.

7. An article carrier according to claim 6 wherein a transverse partition panel is disposed generally midway between said partition strips.

8. An article carrier according to claim 7 wherein said transverse partition panel is secured at one end to said one side wall and foldably joined at the other end to said medial partition structure.

* * * * *